United States Patent [19]

Yamada et al.

[11] Patent Number: 4,483,301

[45] Date of Patent: Nov. 20, 1984

[54] METHOD AND APPARATUS FOR CONTROLLING FUEL INJECTION IN ACCORDANCE WITH CALCULATED BASIC AMOUNT

[75] Inventors: Yasuo Yamada, Oogaki; Shiro Nagasawa, Kariya; Takao Niwa; Takeshi Gouno, both of Susono, all of Japan

[73] Assignees: Nippondenso Co., Ltd., Kariya; Toyota Jidosha Kabushiki Kaisha, Toyota, both of Japan

[21] Appl. No.: 413,900

[22] Filed: Sep. 1, 1982

[30] Foreign Application Priority Data

Sep. 3, 1981 [JP] Japan ..... 56-137790
Sep. 18, 1981 [JP] Japan ..... 56-147308

[51] Int. Cl.[3] ..... F02M 51/00

[52] U.S. Cl. ..... 123/489; 123/478; 123/480

[58] Field of Search ..... 123/489, 480, 478

[56] References Cited

U.S. PATENT DOCUMENTS

| | | | |
|---|---|---|---|
| 4,143,623 | 3/1979 | Norimatsu et al. | 123/489 |
| 4,155,332 | 5/1979 | Yaegashi et al. | 123/480 |
| 4,170,201 | 10/1979 | Camp et al. | 123/489 |
| 4,359,992 | 11/1982 | Asano et al. | 123/480 |
| 4,365,599 | 12/1982 | Ikeura | 123/489 |
| 4,377,143 | 3/1983 | Hamburg | 123/489 |
| 4,391,253 | 7/1983 | Ito | 123/480 |

*Primary Examiner*—Parshotam S. Lall
*Attorney, Agent, or Firm*—Cushman, Darby & Cushman

[57] ABSTRACT

In the method and apparatus for controlling electronically the fuel injection in an internal combustion engine, an interruption routine of the main routine is performed. In the interruption routine, the control logic is selected in accordance with the value of the calculated basic width of the pulse for the fuel injection. The degree of increase or decrease of the amount of the fuel injection is regulated based on the selected control logic.

12 Claims, 11 Drawing Figures

METHOD AND APPARATUS FOR CONTROLLING FUEL INJECTION IN ACCORDANCE WITH CALCULATED BASIC AMOUNT

BACKGROUND OF THE INVENTION

1. Field of the Invention

The present invention relates to a method and apparatus for controlling electronically the fuel injection in an internal combustion engine. The present invention is applicable to the internal combustion engine of automobiles.

2. Description of the Prior Art

In general, to control the amount of fuel injection in an internal combustion engine having an oxygen ($O_2$) sensor and a three-way catalytic converter, the density of $O_2$ in the exhaust gas is detected and closed-loop control for attaining the stoichiometric air-fuel ratio is carried out over the entire range of engine load.

SUMMARY OF THE INVENTION

The above-mentioned system, however has a disadvantage, in that, the emission of hydrocarbons (HC), carbon monoxide (CO), nitrous oxides ($NO_x$), and other harmful gases increases along with the engine load. Therefore, there is inherently less emission of harmful gases in the low engine load range, and hence it is not necessary to operate the engine at the stoichiometric air-fuel ratio. Accordingly, it is possible to operate the engine at a leaner air-fuel ratio than the stoichiometric air-fuel ratio in the engine load is low. However, in the above-mentioned system, the control is carried out so as to maintain always the stoichiometrical air-fuel ratio. Therefore, the above-mentioned system is disadvantageous from the viewpoint of the efficiency of the fuel consumption.

It is the main object of the present invention to provide an improved method and apparatus for controlling electronically the fuel injection in an internal combustion engine, wherein appropriate control of the fuel injection is carried out without reduction of engine drivability, cleaning of the exhaust gas is ensured, and the efficiency of the fuel consumption is improved.

In accordance with the fundamental aspect of the present invention, there is provided a method and apparatus for controlling electronically the fuel injection in an internal combustion engine in which signals representing the engine running conditions including the intake air amount are employed to determine a basic fuel injection amount. The engine load range is divided into at least first and second ranges using the calculated basic fuel amount as a parameter. The basic fuel amount is decreased when the basic fuel amount is less than a predetermined value.

DESCRIPTION OF THE PREFERRED EMBODIMENTS

Figure 1:
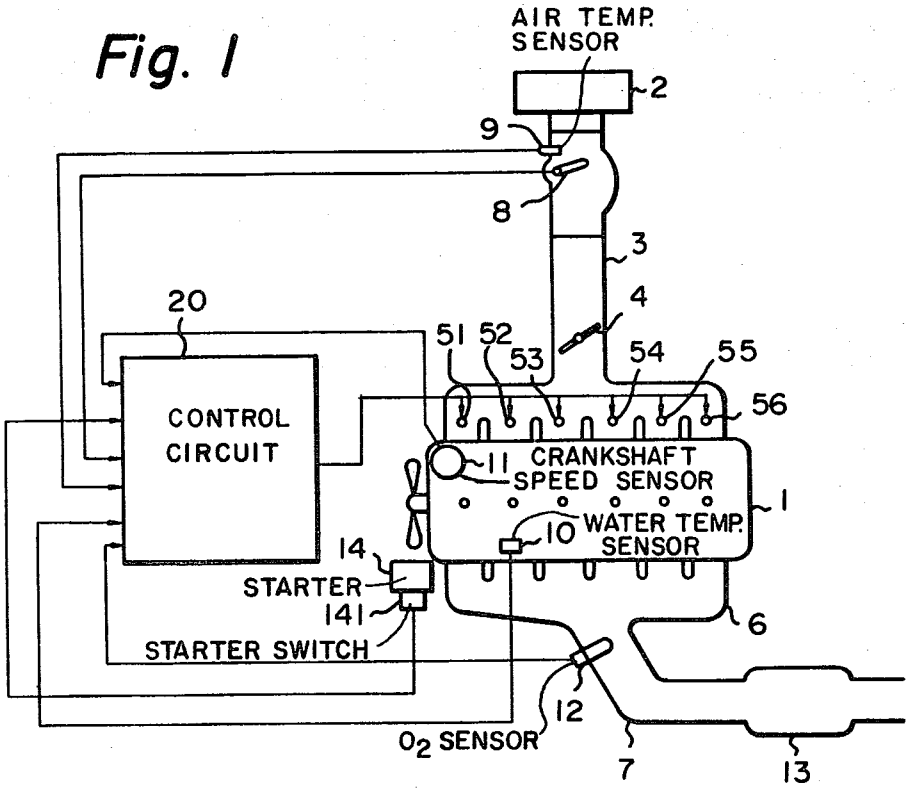
FIG. 1 illustrates an apparatus for controlling electronically the fuel injection in an internal combustion engine according to an embodiment of the present invention.

In FIG. 1, there is shown an apparatus for controlling electronically the fuel injection in an internal combustion engine according to one embodiment of the present invention. The apparatus comprises an internal combustion engine 1 of the four-cycle spark-ignition type for driving an automobile, an air cleaner 2, an air intake pipe 3, a throttle valve 4, fuel injection solenoid valves 51, 52, 53, 54, 55, and 56, an exhaust gas manifold 6, an exhaust pipe 7, an exhaust gas cleaner 13 with a three-way catalytic converter, and a starter 14 of the engine having a starter switch 141.

The apparatus of FIG. 1 also comprises an intake air amount sensor 8 of the potentiometer type, an intake air temperature sensor 9 of the thermistor type, an engine crankshaft rotation speed sensor 11 using ignition pulse signals produced from the primary winding of the ignition coil of the engine ignition device, an engine coolant-water temperature sensor 10, and $O_2$ sensor 12 for sensing the density of oxygen gas in the exhaust gas, and a control circuit 20 for controlling the solenoid valves.

The control circuit 20 receives signals from the intake air amount sensor 8, the intake air temperature sensor 9, the rotation speed sensor 11, the coolant water temperature sensor 10, the starter switch 141, and the $O_2$ sensor 12, carries out calculations based on the received signals, and produces the signal supplied to the solenoid valves 51 through 56.

Figure 2:
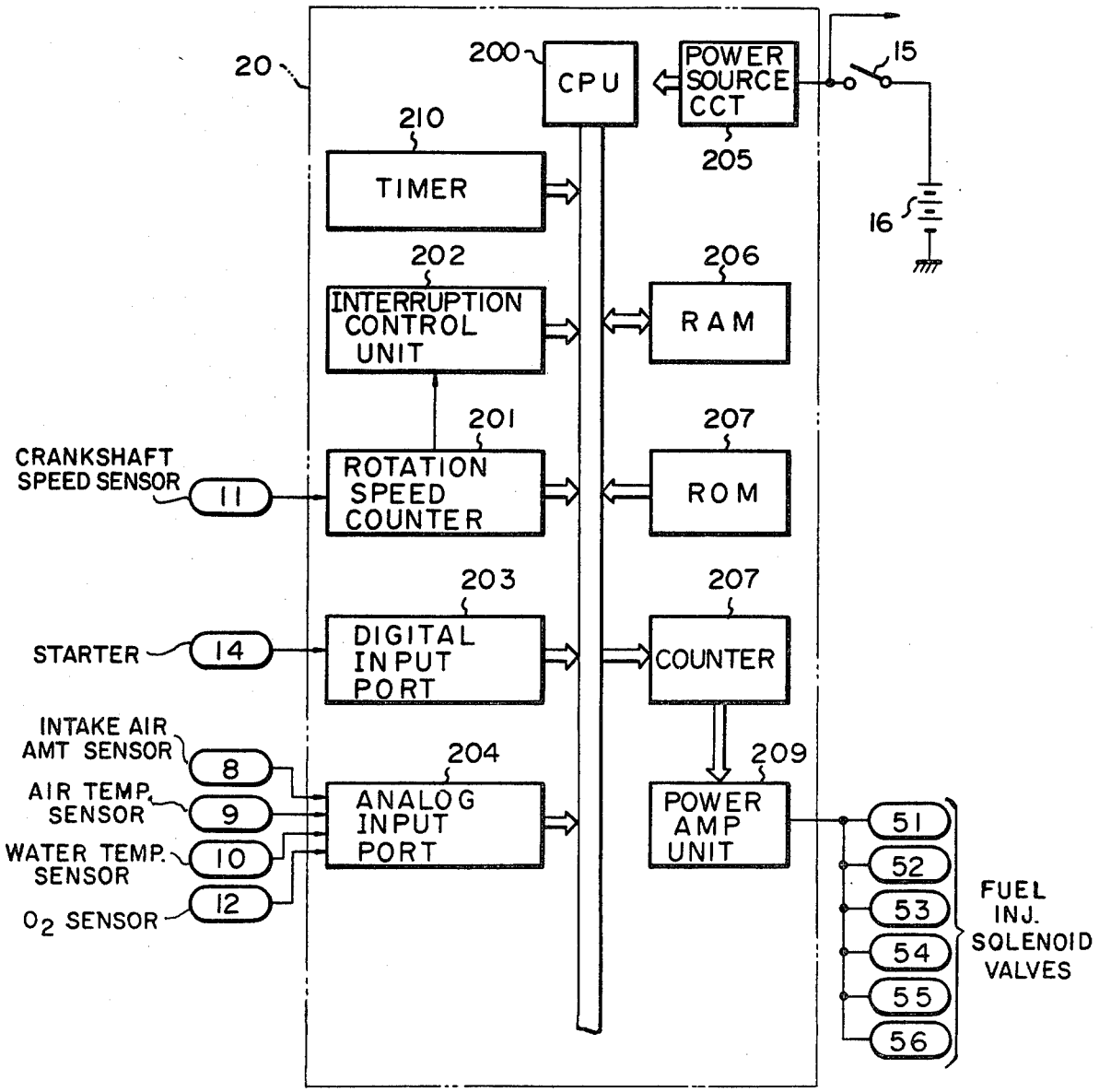
FIG. 2 illustrates the structure of the control circuit in the apparatus of FIG. 1.

Referring to FIG. 2, the control circuit 20 comprises a microprocessor (central processing unit (CPU)) 200, a rotation speed counter 201, an interruption control unit 202, a digital input port 203, an analog input port 204, a power source circuit 205, a random access memory (RAM) 206, a read only memory (ROM) 207, a register-containing counter 208 for converting a digital signal representing a fuel amount into a pulse signal for defining the open-state period of the solenoid valves 51 through 56, a power amplifying unit 209, a timer 210, and a common bus 212. The rotation speed counter 201 receives the signal from the rotation speed sensor 11, the digital input port 203 receives the signal from the starter switch 141, and the analog input port 204 receives the signals from the intake air amount sensor 8, the intake air temperature sensor 9, the coolant water temperature sensor 10, and the $O_2$ sensor 12.

In the apparatus of FIG. 1, control circuit 20 controls the fuel injection, i.e., increases or reduces the final amount of the fuel injection, in accordance with the basic width $T_p$ of the pulse for the fuel injection.

Figure 3:
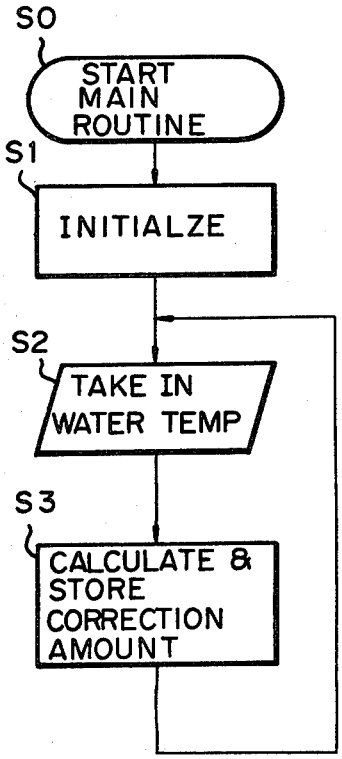
FIGS. 3, 4, and 5 are flow charts representing an example of the calculation process by the control circuit of FIG. 2.
Figure 4:
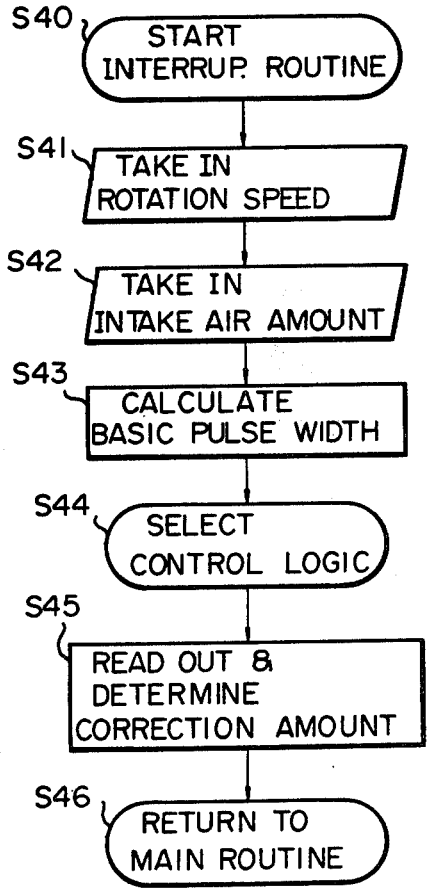
Figure 5:
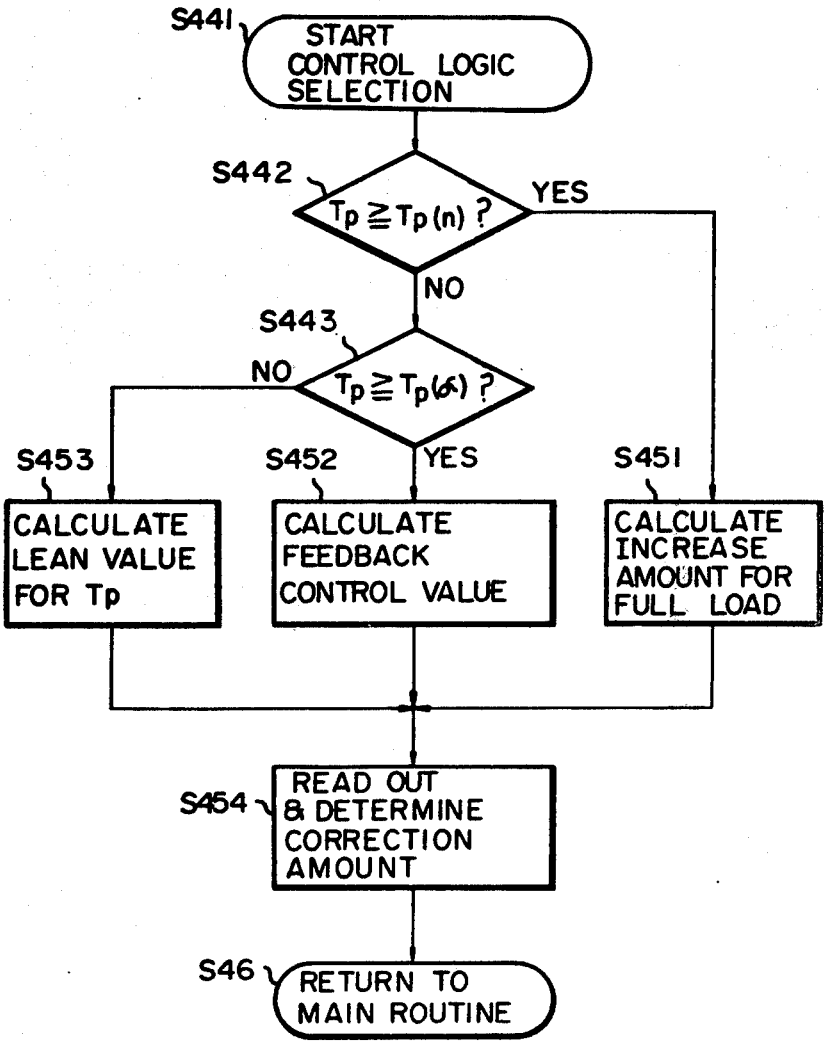

Flow charts representing an example of the calculation process of the control circuit 20 for carrying out such control are illustrated in FIGS. 3, 4, and 5.

The main routine in the microprocessor 200 is illustrated in FIG. 3. In step S0, the main routine is started. In step S1, the initialization is carried out. In step S2, the temperature of the coolant water is taken in. In step S3, the amount of correction of the fuel amount is calculated and the calculated correction amount is stored in the RAM 206. After completing step S3, the routine goes back to step S2 and steps S2 and S3 are carried out repeatedly.

The interruption routine in the microprocessor 200 is illustrated in FIG. 4. Each time an interruption signal from the interruption control unit 202 is supplied to the microprocessor 200, the main routine in the microprocessor 200 is stopped and the interruption routine illustrated in FIG. 4 is carried out.

In step S40, the interruption routine is started. In step S41, the rotation speed N is taken in. In step S42, the amount Q of the intake air is taken in. In step S43, the basic width $T_p$ of the pulse for the fuel injection is calculated according to the following equation by using the rotation speed N, the intake air amount Q, and a predetermined constant F.

$$T_p = F.(Q/N)$$

In step S44, the control logic, i.e., the increase, feedback, and reduction of the amount of the fuel injection, is selected in accordance with the basic width $T_p$. In step S45, the amount of correction corresponding to the result of the selection in step S44 is read out from the ROM 207, and the correction to set the final air-fuel ratio is calculated. In step S46, the interruption routine returns to the main routine of FIG. 3.

The details of steps S44 and S45 will now be explained with reference to the flow chart of FIG. 5. Step S44 consists of steps S441, S442, and S443, and step S45 consists of steps S451, S452, S453, and S454. In step S441, the selection of the control logic is started. In step S442, the decision as to whether the inequality $T_p > T_p(n)$ is affirmative is carried out. $T_p(n)$ is a predetermined pulse width selected in relation to load as will be described below. When the decision is YES, the process proceeds to step S451, while when the decision is NO, the process proceeds the step S443. In step S443, the decision as to whether the inequality $T_p \geqq T_p(\alpha)$ is affirmative is carried out. $T_p(\alpha)$ is another predetermined pulse width selected in relation to load as will be described below. When the decision is YES, the process proceeds to step S452, while when the decision is NO, the process proceeds to step S453.

In step S451, an amount of increase of fuel injection for the full load is calculated. In step S452, a value for feedback control is calculated. In step S453, a lean value corresponding to the value of $T_p$ is calculated. In step S454, the amount of correction for the fuel injection calculated in the main routine of FIG. 3 is read out from the RAM 206 and the amount of correction for the fuel injection to set the final air-fuel ratio is obtained.

The principle of step S44, i.e., the selection of control logic, and step S45, i.e., the obtainment of the amount of correction for the fuel injection, is explained with reference to the characteristics graph of FIG. 7. In the characteristic graph of FIG. 7, the abscissa represents the rotation speed of the engine ($\times 10^3$ rpm) and the ordinate represents the pressure of the air intake pipe (mmHg). Curves are drawn as illustrated with the parameters $T_p(1)$, $T_p(2)$, . . . , $T_p(n)$, representing various fuel injection pulse widths, under the condition that the engine is operated with the same air-fuel ratio characteristic for each engine load. An L-Jetronic type fuel injection system was used to obtain the characteristics graph of FIG. 7.

Figure 7:
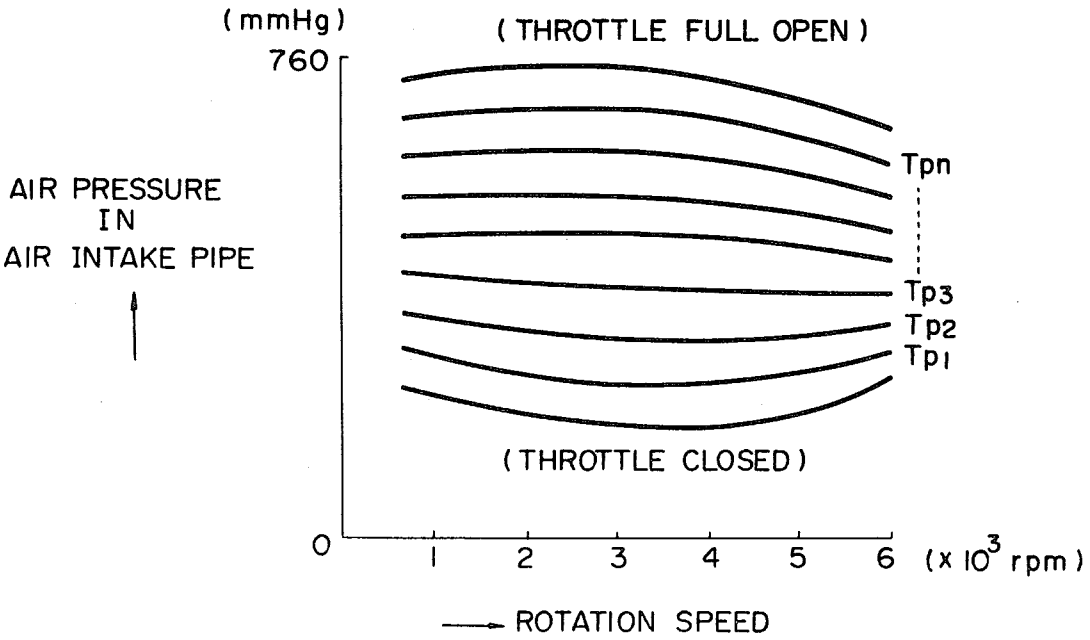
FIG. 7 is a characteristic graph for explaining the principle of the control carried out in the routines of FIGS. 3, 4, and 5.

As is observed in FIG. 7, the fuel injection pulse width for a predetermined engine load has an approximately proportional characteristic, although the curves do not generally become straight lines because of the change of volumetric efficiency according to the engine rotation speed. Accordingly, the value Q/N can be construed as a parameter which represents the engine load.

Curves are drawn in FIG. 7 with the parameters $T_p(0)$, $T_p(1)$, . . . , $T_p(n)$, where the difference between $T_p(0)$ and $T_p(n)$ is divided by n to give division points $T_p(1)$, $T_p(2)$, . . . , $T_p(n-1)$. The value $T_p(\alpha)$ satisfies the relationship $T_p(0) < T_p(\alpha) < T_p(n)$. The degree of increase or the degree of reduction of the amount of the fuel injection is predetermined for a given running condition in accordance with the value $T_p$. The feedback control is carried out in the medium load, from the viewpoint of the emission. Thus, the operation mode according to the value $T_p$ is expressed in the following table.

| | $T_p$ | Load | Operation mode |
|---|---|---|---|
| (A) | $T_p(0) \leqq T_p \leqq T_p(\alpha)$ | Light | Lean control |
| (B) | $T_p(\alpha) \leqq T_p \leqq T_p(n)$ | Medium | Feedback control for $\lambda = 1$ |
| (C) | $T_{pn} \leqq T_p$ | Heavy | Fuel enrichment control |

It will be understood that this table corresponds to steps S453, S452, and S451 of the flow chart of FIG. 5.

Figure 6A:
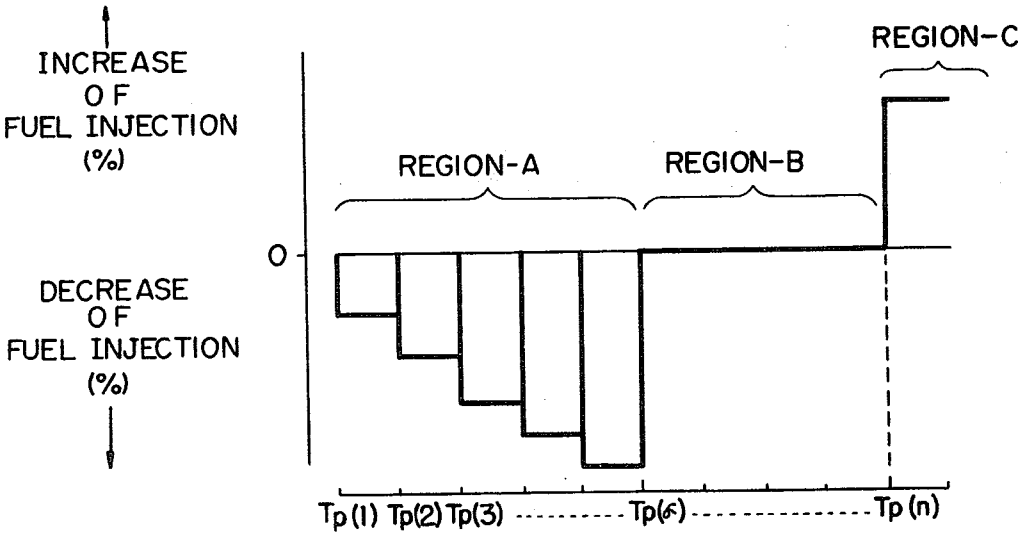
FIGS. 6A and 6B illustrate operation characteristics of the apparatus of FIG. 1.
Figure 6B:
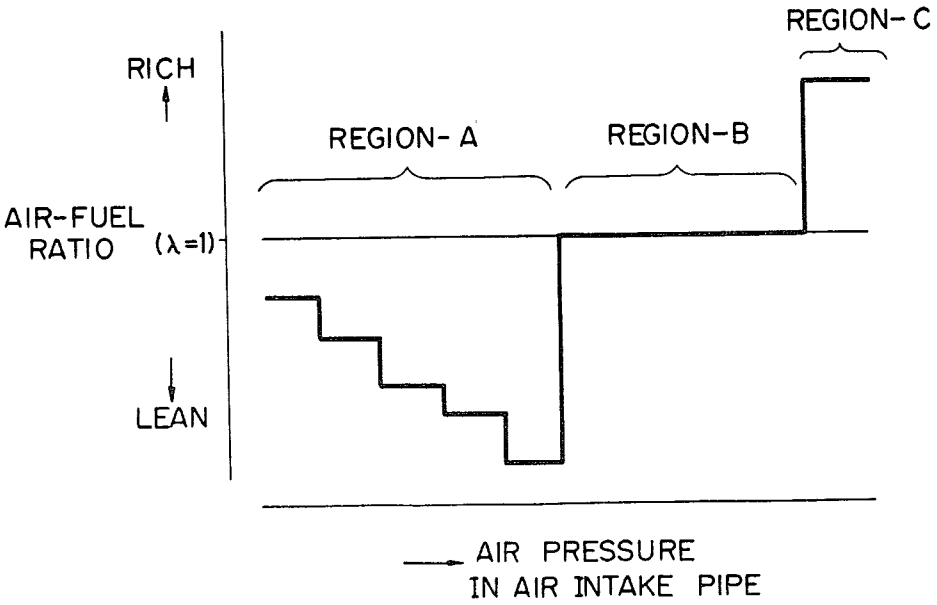

With regard to the obtainment of the amount of correction for the fuel injection in step S45 of FIG. 4, the relationship between the basic widths $T_p(1)$, $T_p(2)$, . . . $T_p(n)$ and the increase or reduction of amount of the fuel injection is illustrated in FIG. 6A and the relationship between the pressure of the intake air in the air intake pipe and the air-fuel ratio under a predetermined rotation speed is illustrated in FIG. 6B.

In region-A, where $T_p(0) \leqq T_p \leqq T_p(\alpha)$, lean control in accordance with the value $T_p$ is carried out. In region-B, where $T_p(\alpha) \leqq T_p \leqq T_p(n)$, neither increase nor reduction of the amount of the fuel injection is carried out, but the feedback control for $\lambda = 1$ is carried out. The $\lambda$ is the air-fuel equivalence ratio, i.e., the ratio of an actual air-fuel ratio to the stoichiometrical ratio. In region-C, where $T_p \geqq T_p(n)$, a predetermined increase of the amount of the fuel injection is established to achieve the fuel enrichment control.

The above description was made in reference to open-loop control. As a modified form, it is possible to use a closed-loop air-fuel ratio control system in which a three-way catalytic converter and an $O_2$ sensor are used and the switching between the feedback control and the closed-loop air-fuel ratio control is carried out according to whether the basic width $T_p$ in question is greater than a predetermined basic width. In this case, the specific fuel consumption can be improved without reducing the emission of the harmful exhaust gases. In this case, it is preferable that the feedback control be carried out in the region of heavy load where the emission of the harmful exhaust gases is increased.

As a further modified embodiment of the present invention, there is provided an apparatus for controlling electronically the fuel injection in an internal combustion engine, in which a hysteresis region is provided which enables continuous and smooth change of torque of the engine during the switching between a feedback control of the air-fuel ratio and a lean control. In this apparatus, the oxygen density in the exhaust gas is detected and the feedback control of the air-fuel ratio is carried out so as to maintain the air-fuel ratio within a predetermined range corresponding to a desired characteristic of a three-way catalytic converter. The so-called partial lean control is a control in which the feedback control of the air-fuel ratio is interrupted and the lean state control of the air-fuel ratio is carried out in a preselected region of the load.

An example of the calculation routine of this embodiment will now be described with reference to the flow chart of FIG. 8. In this example, a feedback control region for a learning control is formed in the bottom portion of the lean region where $T_p$ takes the least value.

In step S500, the routine is started. In step S501, the decision as to whether the inequality $T_p > T_p(0)$ is established is carried out. $T_p$ is the present basic width of the pulse for the fuel injection, while $T_p(0)$ is a predetermined basic width of the pulse for the fuel injection. When the decision of step S501 is YES, the process proceeds to step S504, while when the decision is NO, the process proceeds to step S502.

In step S502, a LEAN FLAG is established, and the process proceeds to step S503. In step S504, the decision as to whether a LEAN FLAG is established is carried out. When the decision is NO, the process proceeds to step S505, while when the decision is YES, the process proceeds to step S506. In step S505, the decision as to whether the inequality $T_p > T_p(1)$ is established is carried out. In step S506, the decision as to whether the inequality $T_p > T_p(2)$ is established is carried out. The value $T_p(1)$ is the predetermined lower limit value of the hysteresis characteristic of $T_p$, while the value $T_p(2)$ is the predetermined higher limit value of the hysteresis characteristic of $T_p$, as illustrated in FIGS. 9A and 9B.

When the decisions of steps S505 and S506 are YES, the processes proceed from steps S505 and S506 to step S507, while when the decisions of steps S505 and S506 are NO, the processes proceed from steps S505 and S506 to step S508. In step S507, the LEAN FLAG is withdrawn, and the process proceeds to step S503. In step S508, a LEAN FLAG is established, and the process proceeds to step S509.

In step S503, the calculation of the feedback control value is carried out, and the process proceeds to step S510. In step S509, the calculation of the LEAN control value corresponding to $T_p$ is carried out, and the process proceeds also to step S501. In step S510, the amount of correction for the fuel injection is obtained. In step S511, the routine reaches the end.

Figure 8:
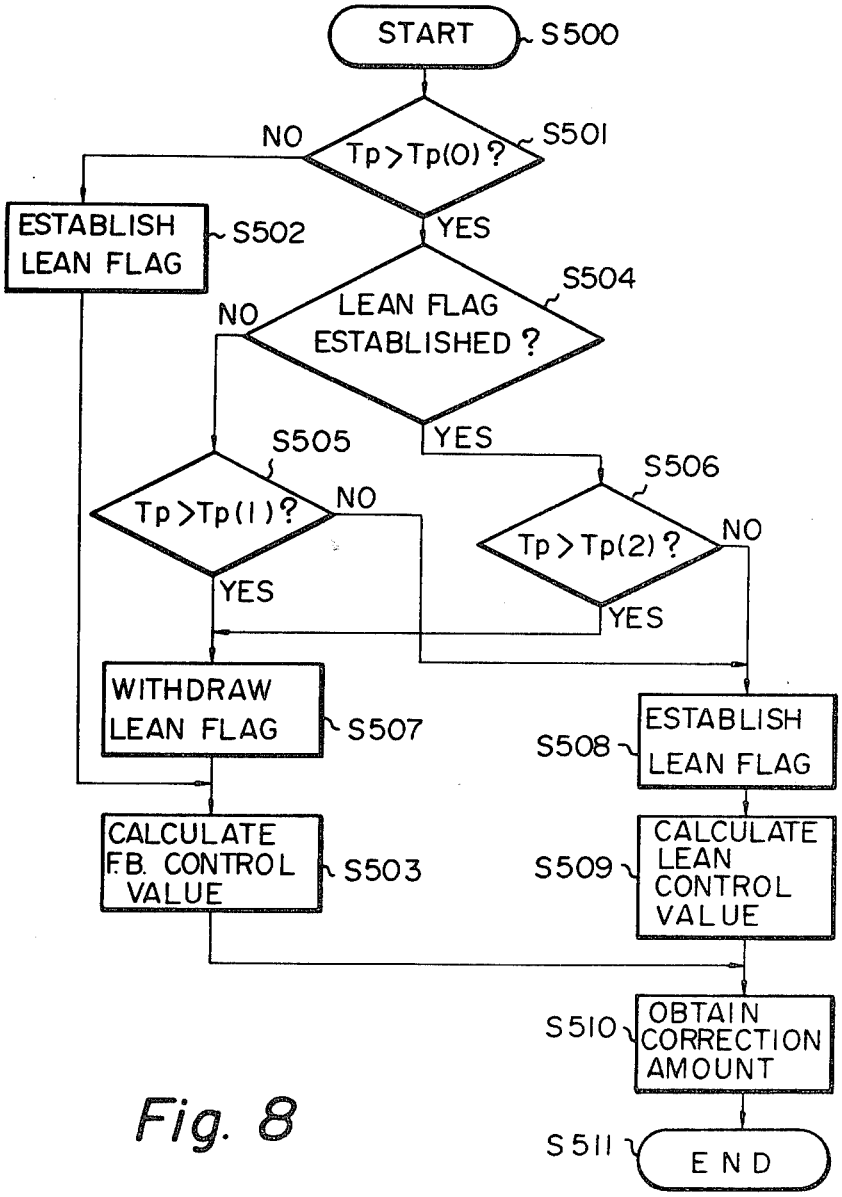
FIG. 8 is a flow chart representing the calculation in accordance with another embodiment of the present invention.
Figure 9A:
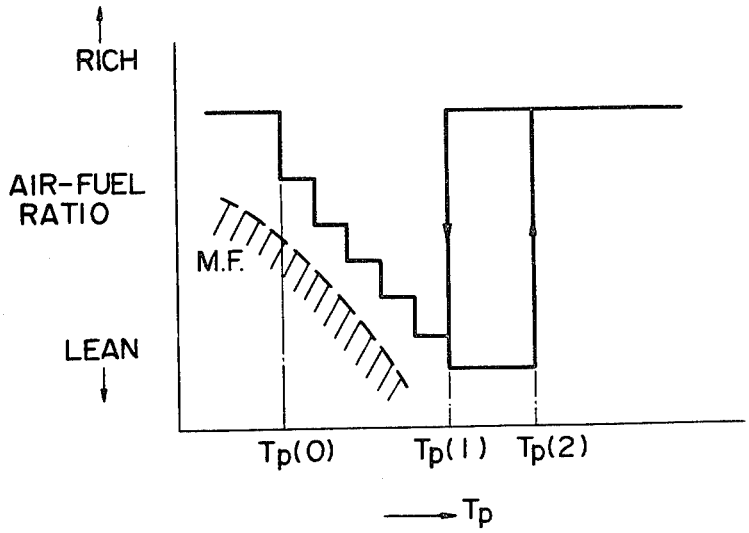
FIGS. 9A and 9B illustrate operation characteristics in accordance with the routine of FIG. 8.
Figure 9B:
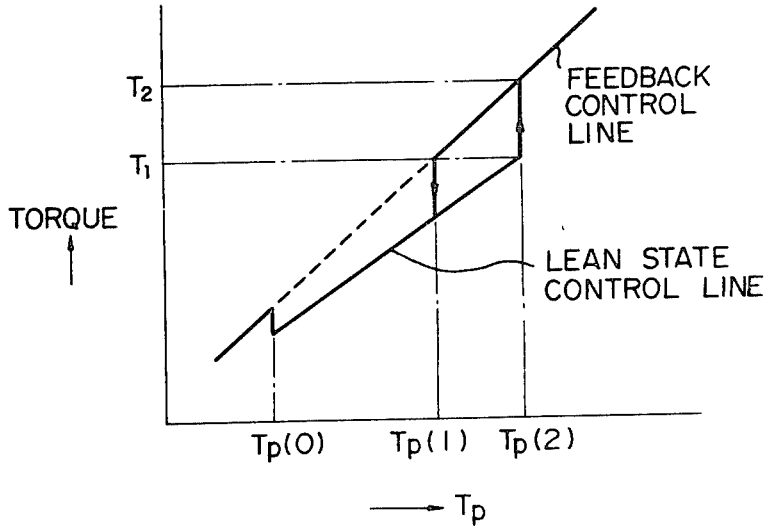

Concerning the routine of FIG. 8 described above, the relationship between the basic width $T_p$ and the air-fuel ratio is illustrated in FIG. 9A, and the relationship between the basic width $T_p$ and the torque of the engine is illustrated in FIG. 9B. In FIG. 9A, the change of the air-fuel ratio in accordance with the change of $T_p$ reveals a hysteresis characteristic. In FIG. 9B, the change of the torque of the engine in accordance with the change of $T_p$ reveals a hysteresis characteristic. In FIG. 9A, the lower left portion below the broken line is the missfire region MF. In FIG. 9B, the feedback control line is drawn in the upper side, while the LEAN state control line is drawn in the lower side.

In the routine of FIG. 8, the learning control is carried out by forming the region of the feedback control for the learning control and, hence, the correctness of the control in the LEAN region is enhanced. However, it is also possible to modify the routine of FIG. 8 to carry out control without forming the feedback control for the learning control. In this modified case, neither step S501 nor S502 is needed.

We claim:

1. A method for controlling electronically the fuel injection in an internal combustion engine comprising the steps of:

obtaining operation values of a plurality of parameters representing engine running condition;

calculating a basic width of a pulse for fuel injection on the basis of said obtained operation values;

preliminarily dividing engine load range into at least a first load range indicative of a light load range and a second load range;

preliminarily associating a first fuel range of values of said basic width with said first load range and a second fuel range of values of said basic width with said second load range;

calculating an amount of decrease of fuel injection according to said basic width when said basic width is in said first fuel range; and carrying out decremental correction of said basic width using said calculated amount of decrease of fuel injection to lean the air-fuel mixture under light load conditions.

2. A method according to claim 1, further comprising the step of correcting the basic width using the signal from a sensor for detecting the constituents of engine exhaust gas when said basic width is in said second fuel range to cause the ratio of the air-fuel mixture supplied to the engine to approach the stoichiometric air-fuel ratio.

3. A method for controlling electronically the fuel injection in an internal combustion engine comprising the steps of:

obtaining operation values of a plurality of parameters representing engine running condition;

calculating a basic width of a pulse for fuel injection on the basis of said obtained operation values;

preliminarily dividing engine load range into at least light load range, a medium load range, and a heavy load range;

preliminarily associating a first fuel range of values of said basic width with said light load range, a second fuel range of values of said basic width with said medium load range and a third fuel range of values of said basic width with said heavy load range;

calculating an amount of decrease of fuel injection according to said basic width when said basic width is in said first fuel range; and carrying out decremental correction of said basic width usiing said calculated amount of decrease of fuel injection to lean the air-fuel mixture under light load conditions.

4. A method according to claim 3, further comprising the step of correcting the basic width using the signal from a sensor for detecting the constituents of engine exhaust gas when said basic width is in said second fuel range to cause the ratio of the air-fuel mixture supplied to the engine to approach the stoichiometric air-fuel ratio.

5. A method according to claim 4, wherein the change from said first fuel range to said second fuel range occurs at a different value of said basic width than the change from said second fuel range to said first fuel range.

6. A method according to claim 4, further comprising the step of increasing the basic width by a predetermined amount when the basic width is in the third fuel range.

7. Apparatus for controlling electronically the fuel injection in an internal combustion engine comprising:

means for sensing parameters representing engine running condition and generating operational values related thereto;

processing means for: (1) determining a basic width of a pulse for fuel injection on the basis of said operational values, and (2) decreasing said basic width when said basic width is in a predetermined fuel injection range related to a predetermined load range to lean the air-fuel mixture under light load conditions; and means, coupled to said processing means, for controlling fuel injection in response to the determination of said processing means.

8. The apparatus according to claim 7, wherein:

said apparatus further comprises means, connected to said processing means, for sensing the constituents of engine exhaust gas; and said processing means also corrects said basic width when said basic width is in another predetermined fuel injection range to cause the ratio of the air-fuel mixture supplied to the engine to approach the stoichiometric air-fuel ratio.

9. Apparatus for controlling electronically the fuel injection in an internal combustion engine comprising:

means for sensing parameters representing engine running condition and generating operational values related thereto;

processing means for: (1) determining a basic width of a pulse for fuel injection on the basis of said operational values, and (2) decreasing said basic width when said basic width is in a predetermined fuel injection range related to a light load range to lean the air-fuel mixture under light load conditions, the load range for said engine including said light load range, a medium load range and a heavy load range; and means, coupled to said processing means, for controlling fuel injection in response to the determinations of said processing means.

10. The apparatus as in claim 9, wherein:

said apparatus further comprises means, connected to said processing means, for sensing the constituents of engine exhaust gas; and said processing means also corrects said basic width when said basic width is in a second predetermined fuel range related to said medium load range to cause the ratio of the air-fuel mixture supplied to the engine to approach the stoichiometric air-fuel ratio.

11. The apparatus according to claim 10 wherein said processing means increases said basic width by a predetermined amount when said basic width is in a third fuel range related to said heavy load range.

12. The apparatus according to claim 10, wherein said processing means causes the change from said first fuel range to said second fuel range to occur at a different value of said basic width than the change from said second fuel range to said first fuel range.

* * * * *

UNITED STATES PATENT AND TRADEMARK OFFICE

CERTIFICATE OF CORRECTION

PATENT NO. : 4,483,301

DATED : November 20, 1984

INVENTOR(S) : Yasuo Yamada et al

It is certified that error appears in the above-identified patent and that said Letters Patent is hereby corrected as shown below:

Column 3, line 34, "$T_p > T_p(n)$" should read --$T_p \geq T_p(n)$--.

Column 4, in the table, "$T_{pn} \leq T_p$" should read --$T_p(n) \leq T_p$--.

Column 5, line 46, "S501" should read --S510--.

Signed and Sealed this

Seventh Day of May 1985

[SEAL]

*Attest:*

DONALD J. QUIGG

*Attesting Officer* *Acting Commissioner of Patents and Trademarks*